US010547108B2

(12) United States Patent
Jeon et al.

(10) Patent No.: US 10,547,108 B2
(45) Date of Patent: Jan. 28, 2020

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Sin-Hyung Jeon, Suwon-si (KR); Kwang-Ho Kim, Yongin-si (KR); Sang-Gi Oh, Yongin-si (KR); Sang-Hyuk Wi, Yongin-si (KR); Dong-Hyun Jeong, Suwon-si (KR); Jeong-Nam Cheon, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 134 days.

(21) Appl. No.: 15/698,538

(22) Filed: Sep. 7, 2017

(65) Prior Publication Data

US 2018/0123242 A1 May 3, 2018

(30) Foreign Application Priority Data

Oct. 28, 2016 (KR) ..... 10-2016-0142187

(51) Int. Cl.
*H01Q 5/30* (2015.01)
*H01Q 21/28* (2006.01)
(Continued)

(52) U.S. Cl.
CPC ..... *H01Q 5/30* (2015.01); *H01Q 1/24* (2013.01); *H01Q 1/521* (2013.01); *H01Q 21/28* (2013.01)

(58) Field of Classification Search
CPC ..... H01Q 5/30; H01Q 1/521; H01Q 1/24; H01Q 21/28
(Continued)

(56) References Cited

U.S. PATENT DOCUMENTS 6,133,879 A * 10/2000 Grangeat ..... H01Q 1/24 343/700 MS
6,864,842 B2 * 3/2005 Hung ..... H01Q 1/38 343/700 MS
(Continued)

FOREIGN PATENT DOCUMENTS

KR 10-2010-0017955 A 2/2010
KR 10-2010-0073144 A 7/2010
(Continued)

OTHER PUBLICATIONS

Chen, Shin-Chang, et al., "A Decoupling Technique for Increasing the Port Isolation Between Two Strongly Coupled Antennas," IEEE Transactions on Antennas and Propagation, vol. 56, No. 12, Dec. 2008, 9 pages.
(Continued)

*Primary Examiner* — Hai V Tran

(57) ABSTRACT

Various embodiments of the present disclosure provide an antenna device and/or an electronic device including the antenna device. The antenna device may include: a circuit board; a conductive layer disposed in a partial region of the circuit board; a first radiation conductor disposed at one side of the conductive layer on the circuit board; and second radiation conductors disposed at one side of the conductive layer on the circuit board, the second radiation conductors being respectively disposed at opposite sides of the first radiation conductor to be symmetrical to each other. The first radiation conductor may transmit or receive a wireless signal in a first frequency band, and the second radiation conductors may transmit or receive a wireless signal in a second frequency band that is different from the first frequency band.

19 Claims, 10 Drawing Sheets

(51) Int. Cl.
*H01Q 1/24* (2006.01)
*H01Q 1/52* (2006.01)

(58) Field of Classification Search
USPC ..... 343/702
See application file for complete search history.

(56) References Cited

U.S. PATENT DOCUMENTS

| | | | | |
|---|---|---|---|---|
| 8,418,928 | B2 * | 4/2013 | Kato | G06K 19/07749 235/487 |
| 9,203,456 | B2 * | 12/2015 | Teng | H01Q 5/35 |
| 2008/0074341 | A1 | 3/2008 | Chung et al. | |
| 2008/0258991 | A1 | 10/2008 | Montgomery et al. | |
| 2008/0278405 | A1 | 11/2008 | Montgomery et al. | |
| 2011/0267245 | A1 | 11/2011 | Park et al. | |
| 2011/0298666 | A1 | 12/2011 | Kim et al. | |
| 2012/0127038 | A1 | 5/2012 | Kim et al. | |
| 2013/0050027 | A1 | 2/2013 | Kim et al. | |
| 2014/0300517 | A1 * | 10/2014 | Onaka | H01Q 1/243 343/700 MS |

FOREIGN PATENT DOCUMENTS

| | | | |
|---|---|---|---|
| KR | 10-1013388 | B1 | 2/2011 |
| KR | 10-2011-0121792 | A | 11/2011 |
| KR | 10-1093365 | B1 | 12/2011 |
| KR | 10-1139703 | B1 | 4/2012 |
| KR | 10-1144518 | B1 | 5/2012 |
| KR | 10-1166090 | B1 | 7/2012 |
| KR | 10-1195047 | B1 | 10/2012 |
| KR | 10-1209621 | B1 | 12/2012 |
| KR | 10-1218702 | B1 | 1/2013 |
| KR | 10-1293660 | B1 | 8/2013 |
| KR | 10-1329647 | B1 | 11/2013 |
| KR | 10-1475295 | B1 | 12/2014 |
| KR | 10-1563459 | B1 | 10/2015 |

OTHER PUBLICATIONS

Jiang, Huan-Jynu, et al., "High-Isolation WLAN MIMO Laptop Computer Antenna Array," Proceedings of APMC 2012, Kaohsiung, Taiwan, Dec. 4-7, 2012, 3 pages.

Noguchi, Akira, et al, "3-element super-directive endfire array with decoupling network," Proceedings of ISAP 2014, Kaohsiung, Taiwan, Dec. 2-5, 2014, 2 pages.

Singh, Hari Shankar, et al., "A Compact Dual-Band Diversity Antenna for WLAN Applications with High Isolation," Microwave and Optical Technology Letters, vol. 57, No. 4, Apr. 2015, 7 pages.

Xia, Xing-Xing, et al., "Design of a Compact Wideband MIMO Antenna for Mobile Terminals," Progress in Electromagnetics Research C, vol. 41, 2013, pp. 163-174.

Yu, Yantao, et al., "Compact Multiport Array with Reduced Mutual Coupling," Progress in Electromagnetics Research Letters, vol. 39, 2013, pp. 161-168.

Zhao, Luyu, et al., "A Coupled Resonator Decoupling Network for Two-Element Compact Antenna Arrays in Mobile Terminals," IEEE Transactions on Antennas and Propagation, vol. 62, No. 5, May 2014, 10 pages.

* cited by examiner

ANTENNA DEVICE AND ELECTRONIC DEVICE INCLUDING THE SAME

CROSS-REFERENCE TO RELATED APPLICATION AND CLAIM OF PRIORITY

This application is related to and claims priority to Korean Application Serial No. 10-2016-0142187 filed on Oct. 28, 2016, the contents of which are incorporated herein by reference.

TECHNICAL FIELD

Various embodiments of the present disclosure relate to an electronic device. For example, various embodiments of the present disclosure relate to an antenna device that transmits/receives wireless signals in various frequency bands, and an electronic device including the antenna device.

BACKGROUND

Typically, an electronic device refers to a device that performs a specific function according to an equipped program, such as an electronic scheduler, a portable multimedia reproducer, a mobile communication terminal, a tablet PC, an image/sound device, a desktop/laptop PC, or a vehicular navigation system, including a home appliance. For example, such an electronic device may output information stored therein as sound or an image. As the degree of integration of such an electronic device has increased, and super-high speed and large capacity wireless communication has become popular, various functions have recently been equipped in a single mobile communication terminal. On the other hand, in accordance with the generalization of super high-speed and large-capacity wireless communication, communication between a user device (e.g., a mobile communication terminal) and another user device via a network as well as communication between things (e.g., home appliances), or between a user device and a thing are gradually being commercialized. Communication between things or communication between a user device and a thing may be performed via a network. Further, direct wireless communication may also be performed between things (or between a user device and a thing) without going through a network.

For example, a method of wirelessly connecting a user device (e.g., a mobile communication terminal) with an auxiliary device, such as an earphone or an external speaker, has already become common, and a technique of directly transmitting information stored in one electronic device to another electronic device without going through other networks or the like is being routinely used. The direct wireless communication between things may be performed, for example, via Bluetooth communication. Examples of the network for providing such wireless communication may include a commercial communication network, a wireless LAN (e.g., WiFi), and the like. In addition, communication between things may be enabled in various forms, such as Near Field Communication (NFC), wireless power transmission/reception, and Magnetic Security Transmission (MST).

An electronic device, which is capable of communicating with other things or with a user device, may require antenna devices that operate in different frequency bands. For example, since radio signals of different frequency bands are transmitted or received depending on communication protocols, an electronic device can be equipped with antenna devices corresponding to respective communication methods.

SUMMARY

To address the above-discussed deficiencies, it is a primary object to provide an antenna device that operates in different frequency bands. When a plurality of antenna devices are disposed adjacent to each other, radiation performance may be degraded due to electromagnetic interference. For example, in order to secure a stable operating environment, antenna devices (e.g., respective radiation conductors) may be arranged at a sufficiently large distance from each other. However, when the radiation conductors are disposed at a large distance from each other, manufacturing costs may increase. For example, due to the increase of the number of steps of disposing respective radiation conductors, the arrangement of control circuits (e.g., a Radio Frequency Integrated Circuit (RFIC)) for controlling respective radiation conductors, and the like, manufacturing costs may increase.

With the advancement of electronic and communication technologies, it has become possible to integrate control circuits for performing control related to different types of communication into one chip, so that the problem of an increase in the manufacturing costs as described above has been partially solved. On the other hand, in order to reduce connection loss between a control circuit and a radiation conductor, it is necessary to dispose the radiation conductor close to the control circuit. However, this means that radiation conductors, which transmit/receive radio signals of different frequency bands are disposed adjacent to each other. For example, there is a high possibility that electromagnetic interference occurs between the radiation conductors, and thus it may be difficult to secure stable radiation performance of the antenna devices.

Various embodiments of the present disclosure are capable of providing an antenna device capable of securing stable radiation performance (capable of suppressing electromagnetic interference between radiation conductors) while disposing a plurality of radiation conductors adjacent to each other, and providing an electronic device including the antenna device.

Various embodiments of the present disclosure are capable of providing a miniaturized antenna device and an electronic device including the antenna device by configuring radiation conductors and/or antenna devices, which operate in different frequency bands, as a single module form.

The various embodiments of the present disclosure are capable of providing an antenna device that can be miniaturized and can reduce manufacturing costs while operating in a plurality of different frequency bands, and providing an electronic device including the antenna device.

Various embodiments of the present disclosure provide an antenna device and/or an electronic device including the antenna device. The antenna device may include: a circuit board; a conductive layer disposed in a partial region of the circuit board; a first radiation conductor disposed at one side of the conductive layer on the circuit board; and second radiation conductors disposed at one side of the conductive layer on the circuit board, the second radiation conductors being respectively disposed at both sides of the first radiation conductor to be symmetrical to each other. The first radiation conductor may transmit/receive a wireless signal in a first frequency band, and the second radiation conductors may transmit/receive a wireless signal in a second frequency band that is different from the first frequency band.

According to one embodiment, the antenna device may further include slits, each of which is formed partially across the conductive layer and adjacent to one of the second radiation conductors.

In another embodiment, the antenna device may further include a connection line that connects feed lines which are respectively connected to the first radiation conductor and the second radiation conductors.

Each of the slits and/or the connection line may be symmetrically disposed about the first radiation conductor.

In the above-described antenna device and/or the electronic device including the same, by arranging the second radiation conductors to be symmetrical to each other about the first radiation conductor and/or including the slits or the connection line, electromagnetic interference can be suppressed between the radiation conductors. For example, a stable radiation performance can be secured even though a plurality of radiation conductors are arranged adjacent to each other. In some embodiments, since stable radiation performance can be secured even though the plurality of radiation conductors are disposed adjacent to each other, the antenna device can be configured in a single modular form while operating in a plurality of different frequency bands. Accordingly, in mounting the antenna device in an electronic device, the manufacturing process can be simplified and the manufacturing costs can be reduced. In one embodiment, depending on the configuration of each of the plurality of radiation conductors, the radiation conductors can independently transmit and receive wireless signals in the same frequency band.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
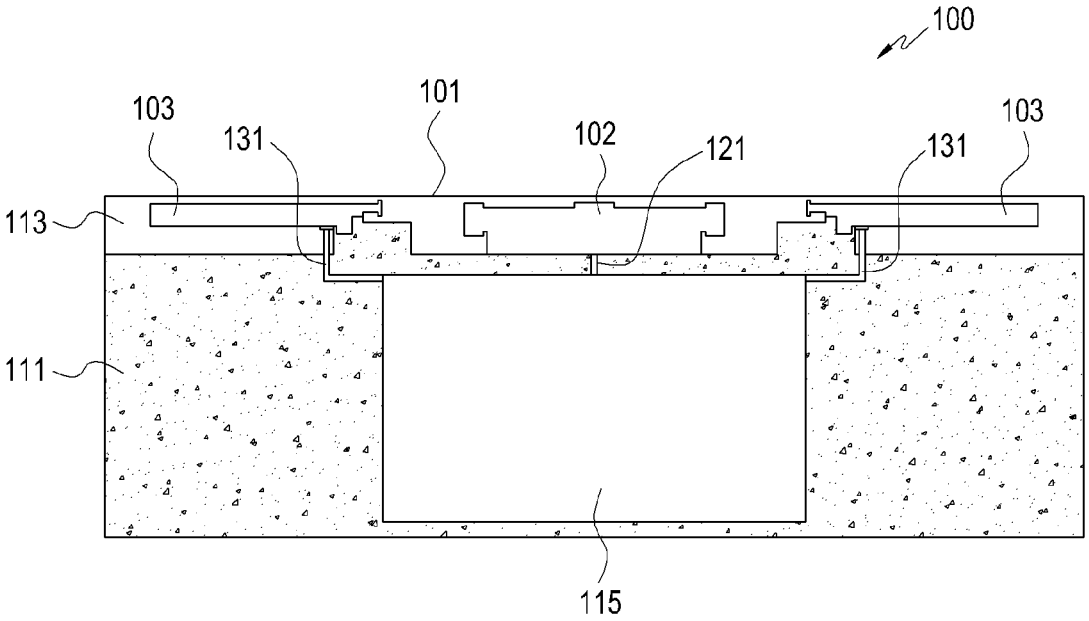
FIG. 1 is a configuration view illustrating an antenna device according to one of various embodiments of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

As the present disclosure allows for various changes and numerous embodiments, some exemplary embodiments will be described in detail with reference to the accompanying drawings. However, it should be understood that the present disclosure is not limited to the specific embodiments, but the present disclosure includes all modifications, equivalents, and alternatives within the spirit and the scope of the present disclosure.

Although ordinal terms such as "first" and "second" may be used to describe various elements, these elements are not limited by the terms. The terms are used merely for the purpose to distinguish an element from the other elements. For example, a first element could be termed a second element, and similarly, a second element could be also termed a first element without departing from the scope of the present disclosure. As used herein, the term "and/or" includes any and all combinations of one or more associated items.

Further, the relative terms "a front surface", "a rear surface", "a top surface", "a bottom surface", and the like which are described with respect to the orientation in the drawings may be replaced by ordinal numbers such as first and second. In the ordinal numbers such as first and second, their order are determined in the mentioned order or arbitrarily and may not be arbitrarily changed if necessary.

In the present disclosure, the terms are used to describe specific embodiments, and are not intended to limit the present disclosure. As used herein, the singular forms are intended to include the plural forms as well, unless the context clearly indicates otherwise. In the description, it should be understood that the terms "include" or "have" indicate existence of a feature, a number, a step, an operation, a structural element, parts, or a combination thereof, and do not previously exclude the existences or probability of addition of one or more another features, numeral, steps, operations, structural elements, parts, or combinations thereof.

Unless defined differently, all terms used herein, which include technical terminologies or scientific terminologies, have the same meaning as that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present specification.

In the present disclosure, an electronic device may be a random device, and the electronic device may be called a terminal, a portable terminal, a mobile terminal, a communication terminal, a portable communication terminal, a portable mobile terminal, a display device or the like.

For example, the electronic device may be a smartphone, a portable phone, a game player, a TV, a display unit, a heads-up display unit for a vehicle, a notebook computer, a laptop computer, a tablet Personal Computer (PC), a Personal Media Player (PMP), a Personal Digital Assistants (PDA), and the like. The electronic device may be implemented as a portable communication terminal which has a wireless communication function and a pocket size. Further, the electronic device may be a flexible device or a flexible display device. In an embodiment, the electronic device may include an AV device such as a sound bar and home appliances such as a refrigerator.

The electronic device may communicate with an external electronic device, such as a server or the like, or perform an operation through an interworking with the external electronic device. For example, the electronic device may transmit an image photographed by a camera and/or position information detected by a sensor unit to the server through a network. The network may be a mobile or cellular communication network, a Local Area Network (LAN), a Wireless Local Area Network (WLAN), a Wide Area Network (WAN), an Internet, a Small Area Network (SAN) or the like, but is not limited thereto.

FIG. 1 is a view illustrating a configuration of an antenna device 100 according to one of various embodiments of the present disclosure.

Referring to FIG. 1, the antenna device 100 may include a plurality of radiation conductors 102 and 103 disposed on a circuit board 101, and among the radiation conductors, second radiation conductors 103 may be disposed on the both sides of the first radiation conductor 102, respectively. In some embodiments, the second radiation conductors 103 may be symmetrically disposed about the first radiation conductor 102. The first radiation conductor 102 and the second radiation conductor(s) 103 may transmit/receive wireless signals in different frequency bands, respectively. According to one embodiment, each of the first radiation conductor 102 and the second radiation conductor(s) 103 may independently transmit/receive wireless signals in the same frequency band.

The circuit board 101 may be, for example, a multi-layered circuit board, and may include a conductive layer 111 disposed in a partial region. The conductive layer 111 may provide a ground to, for example, the radiation conductors 102 and 103 and/or electronic components (e.g., an RFIC chip 115) disposed on the circuit board 101. According to one embodiment, the circuit board 101 may be a multi-layer circuit board, and the conductive layer 111 may be formed in one of a plurality of layers constituting the circuit board. According to one embodiment, in a plan view, the conductive layer 111 may be formed in a part in the region of the circuit board 101, and no conductive layer may be formed in another region. Hereinafter, a region where the conductive layer 111 is not formed in the region of the circuit board 101 will be referred to as a "fill-cut region 113."

According to various embodiments, the first radiation conductor 102 may be disposed on one side of the conductive layer 111 (e.g., on the fill-cut region 113) on the circuit board 101, for example, as a radiation conductor for Bluetooth communication. In one embodiment, the first radiation conductor 102 may have a shape extending along one direction (e.g., the transverse direction in FIG. 1), and may be disposed adjacent to an edge of the circuit board 101. The antenna device 100 may further include a first feed line 121 connected to the first radiation conductor 102. For example, the first feed line 121 may connect the first radiation conductor 102 to the RFIC chip 115. The first feed line 121 may be a printed circuit pattern formed on a layer different from the conductive layer 111. In some embodiments, the first radiation conductor 102 may have a shape symmetrical about the first feed line 121.

According to various embodiments, the second radiation conductor(s) 103 may be, for example, radiation conductors for wireless LAN (e.g., WiFi) communication, and may be arranged in a plural number to perform a Multi Input Multi Output (MIMO) function. The second radiation conductors 103 may be disposed on the both sides of the first radiation conductor 102, respectively, while being arranged on one side (e.g., the fill-cut region 113) of the conductive layer 111 on the circuit board 101. In some embodiments, the second radiation conductors 103 may be symmetrically disposed about the first radiation conductor 102 (e.g., the first feed line 121). According to various embodiments, the second radiation conductors 103 may be disposed adjacent to the edges of the circuit board 101, respectively.

According to various embodiments, the antenna device 100 may further include second feed lines 131, which are connected to the second radiation conductors 103, respectively. For example, the second feed lines 131 may respectively connect the second radiation conductors 103 to the RFIC chip 115. The second feed lines 131 may be a printed circuit pattern formed on a layer different from the conductive layer 111. In some embodiments, the second feed lines 131 may be symmetrically disposed about the first radiation conductor 102 (e.g., the first feed line 121).

Figure 2:
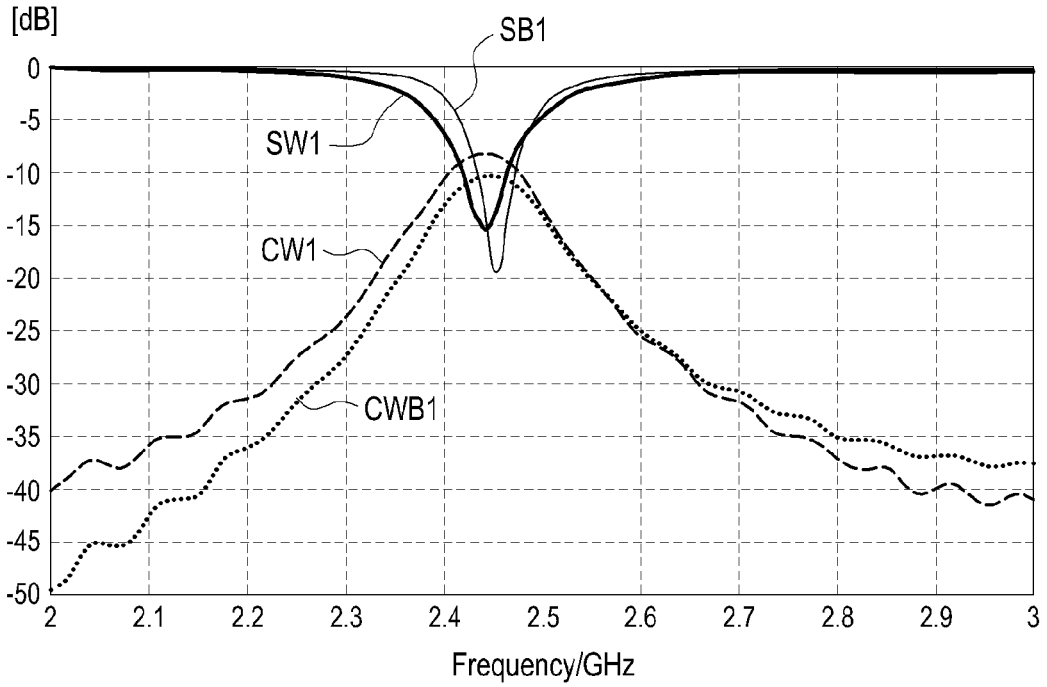
FIG. 2 illustrates a graph for describing a radiation characteristic of the antenna device according to one of various embodiments of the present disclosure.

FIG. 2 is a graph for describing a radiation characteristic of the antenna device (e.g., the antenna device 100 of FIG. 1) according to one of various embodiments of the present disclosure.

Referring to FIG. 2, "SB1" is a graph representing the reflection coefficient (S-parameter) of the first radiation conductor 102, which has been measured in the antenna device 100; "SW1" is a graph representing the reflection coefficient of the second radiation conductor(s) 103, which has been measured in the antenna device 100; "CWB1" is a graph representing electromagnetic coupling between the first radiation conductor 102 and the second radiation conductor(s) 103, which has been measured in the antenna device 100; and "CW1" is a graph representing electromagnetic coupling between the second radiation conductors 103 which has been measured in the antenna device 100.

In view of the measurement results of the reflection coefficient, it can be seen that each of the first radiation conductor 102 and the second radiation conductors 103 forms a resonance frequency in an about 2.4 to 2.5 GHz band. For example, on the both sides of the first radiation conductor 102, which transmits/receives in the first frequency band, the second radiation conductors 103, which transmit/receive wireless signals in a second frequency band (e.g., a frequency band different from the first frequency band) are respectively disposed, and resonant frequencies may be formed in the frequency bands corresponding to the respective radiation conductors. According to one embodiment, the second radiation conductors 103 may be symmetrically disposed about the first radiation conductor 102.

In view of the measurement results of electromagnetic coupling, it can be seen that a certain degree of electromagnetic coupling occurs between the first radiation conductor 102 and the second radiation conductor(s) 103 and/or between the second radiation conductors 103 in the frequency bands described above. Electromagnetic coupling means that an interference phenomenon appears between radiation conductors. For example, it may mean that an interruption phenomenon of sound heard by a user or a noise occurs in transmitting a sound signal in a wireless manner.

An antenna device having a structure that further improves the above-mentioned interference phenomenon (e.g., electromagnetic coupling between radiation conductors) will be described through embodiments to be described later. In describing the following embodiments, the components that are the same as those of the preceding embodiments or can be easily understood from descriptions of the preceding embodiment may be denoted by the same reference numerals or the reference numerals thereof or may be omitted, and the detailed descriptions thereof may also be omitted.

Figure 3:
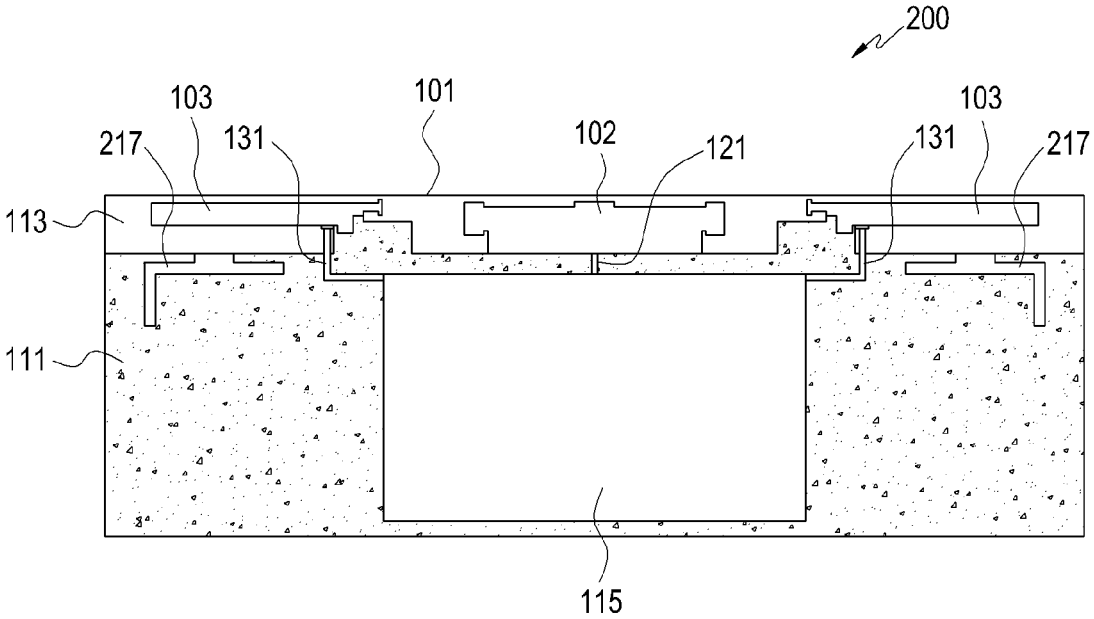
FIG. 3 is a configuration view illustrating an antenna device according to another one of various embodiments of the present disclosure.

FIG. 3 is a view illustrating a configuration of an antenna device 200 according to another one of various embodiments of the present disclosure.

Referring to FIG. 3, the antenna device 200 may further include a slit(s) 217 extending partly across the conductive layer 111. For example, the slit(s) 217 may extend across the conductive layer 111 from the fill-cut region 113. According to various embodiments, the slits(s) 217 may be formed regions adjacent to the second radiation conductors 103, respectively, and may be disposed symmetrically to each other about the first radiation conductor 102 and/or the first feed line 121. The shape of the slit(s) 217 (e.g., the extension trace of the slit(s) 217) may vary depending on a specification required for the antenna device 200 or an arrangement, shapes, or the like of the other components (e.g., the first radiation conductor 102 and/or the second radiation conductors 103).

Figure 4:
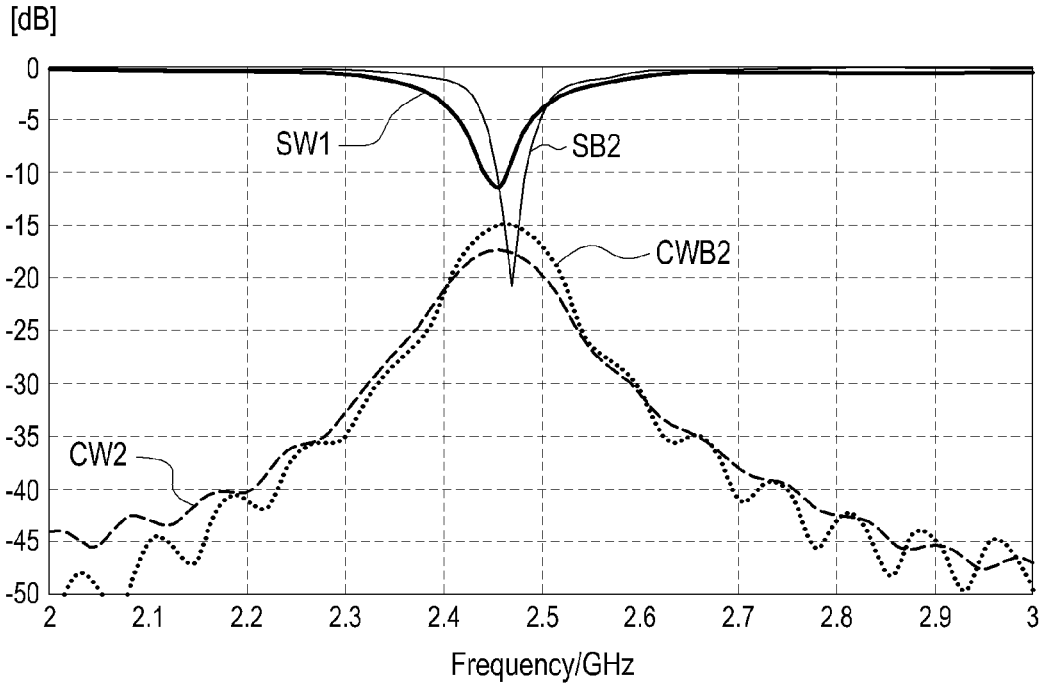
FIG. 4 illustrates a graph for describing a radiation characteristic of the antenna device according to another one of various embodiments of the present disclosure.

FIG. 4 is a graph for describing a radiation characteristic of the antenna device (e.g., the antenna device 200 of FIG. 3) according to another one of various embodiments of the present disclosure.

Referring to FIG. 4, "SB2" is a graph representing the reflection coefficient of the first radiation conductor 102, which has been measured in the antenna device 200; "SW1" is a graph representing the reflection coefficient of the second radiation conductor(s) 103, which has been measured in the antenna device 200; "CWB2" is a graph representing electromagnetic coupling between the first radiation conductor 102 and the second radiation conductor(s) 103, which has been measured in the antenna device 200; and "CW2" is a graph representing electromagnetic coupling between the second radiation conductors 103, which has been measured in the antenna device 200.

In view of the measurement results of the reflection coefficient, similarly to the antenna device 100 of FIG. 1, it can be seen that each of the first radiation conductor 102 and the second radiation conductors 103 forms a resonance frequency in an about 2.4 to 2.5 GHz band.

Compared to the measurement results of electromagnetic coupling of the antenna device 100 of FIG. 1, it can be seen that the antenna device 200 is improved by about 5 dB in electromagnetic coupling between the first and second radiation conductor(s) 102 and 103 and improved about 11 dB in electromagnetic coupling between the second radiation conductors 103. For example, in the antenna device according to various embodiments of the present disclosure, the electromagnetic coupling between the first radiation conductor 102 and the second radiation conductors 103 and/or the electromagnetic coupling between the second radiation conductors 103 can be improved by forming the slit 217 in the conductive layer 111. Thus, since stable radiation performance can be ensured while the plurality of radiation conductors are disposed adjacent to each other, the antenna device according to various embodiments of the present disclosure may be easily miniaturized while transmitting/receiving wireless signals in a plurality of different frequency bands. In some embodiments, by forming the slits 217 in the conductive layer 111, it is possible to suppress the occurrence of a sound interruption phenomenon or a noise when a sound signal is transmitted through the first radiation conductor 102 and/or the second radiation conductor(s) 103.

Figure 5:
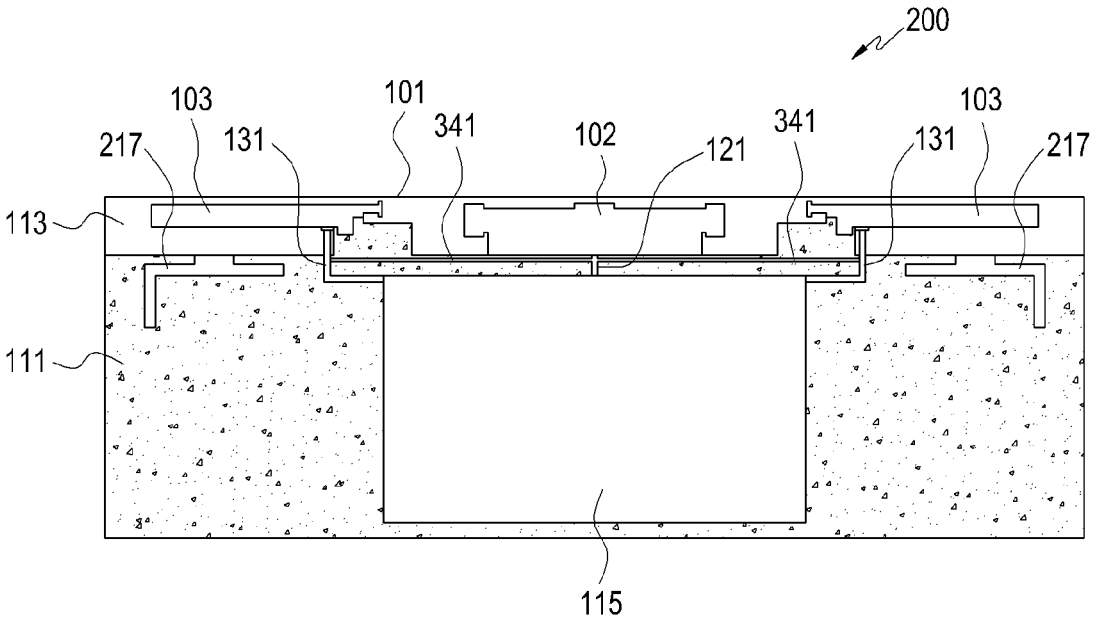
FIG. 5 is a configuration view illustrating an antenna device according to still another one of various embodiments of the present disclosure.
Figure 6:
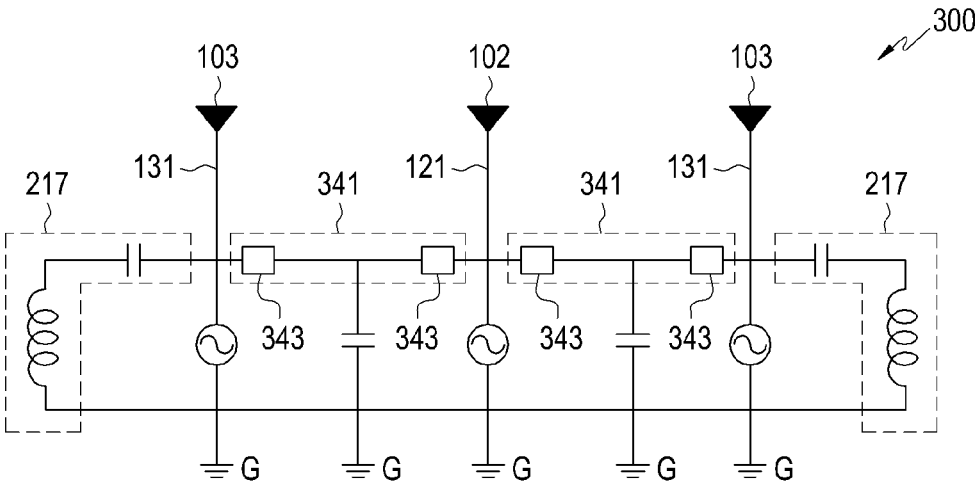
FIG. 6 illustrates an equivalent circuit diagram of the antenna device according to still another one of various embodiments of the present disclosure.

FIG. 5 is a configuration view illustrating an antenna device 300 according to still another one of various embodiments of the present disclosure. FIG. 6 is an equivalent circuit diagram of the antenna device 300 according to still another one of various embodiments of the present disclosure.

Referring to FIGS. 5 and 6, the antenna device 300 further includes slits 217, each of which extends partly across the conductive layer 111, and connection lines 341, which are connected to the first feed line 121 and the second feed line 131, respectively. The connection line(s) 341 may be a portion of a printed circuit pattern formed on the circuit board 101, and may be formed in a layer different from the conductive layer 111. In one embodiment, the connection line(s) 341 is formed in a layer different from the conductive layer 111 at a position overlapping with the conductive layer 111 in a plan view, thereby forming capacitive coupling with the conductive layer 111.

According to various embodiments, the connection lines 341 may be connected to the second feed lines 131 at the opposite ends thereof, respectively, while intersecting the first feed line 121. For example, the connection lines 341 may respectively connect the second feed lines 131 to the first feed line 121. The connection line(s) 341 may form capacitive coupling with the conductive layer 111, for example, a ground layer G. In some embodiments, the connection line 341 may include at least one lumped element 343 (e.g., a resistive element, a capacitive element, or an inductive element) disposed between the first feed line 121 and the second feed line(s) 131. In one embodiment, the connection lines 341 may be symmetrically disposed about the first radiation conductor 102 (e.g., the first feed line 121). In some embodiments, when the connection line 341 includes lumped elements 343, the lumped elements 343 may be symmetrically disposed about the first radiation conductor 102 (e.g., the first feed line 121).

In one embodiment, by disposing the connection line 341, a loop circuit may be formed on the feed structure of the antenna device 300. For example, when the connection line 341 is disposed, a loop circuit may be configured with a combination of the connection line 341, the slits 217, and the conductive layer 111 (e.g., the ground layer G). Such a loop circuit may improve the electromagnetic coupling between the first radiation conductor 102 and the second radiation conductor(s) 103 and/or the electromagnetic coupling between the second radiation conductors 103.

Figure 7:
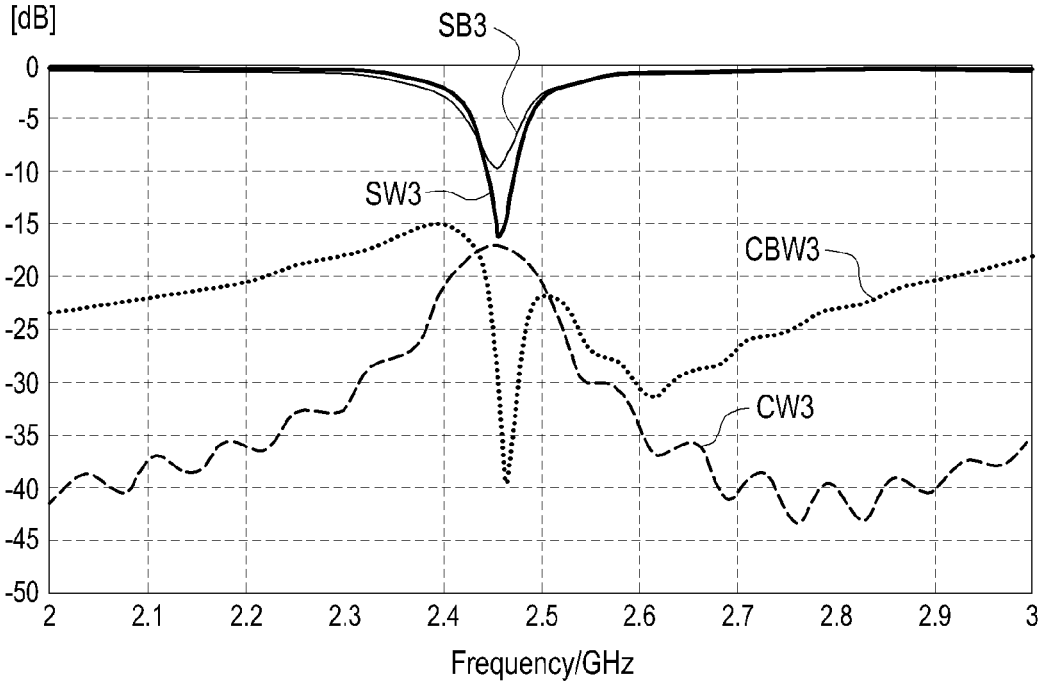
FIG. 7 illustrates a graph for describing a radiation characteristic of the antenna device according to still another one of various embodiments of the present disclosure.
Figure 8:
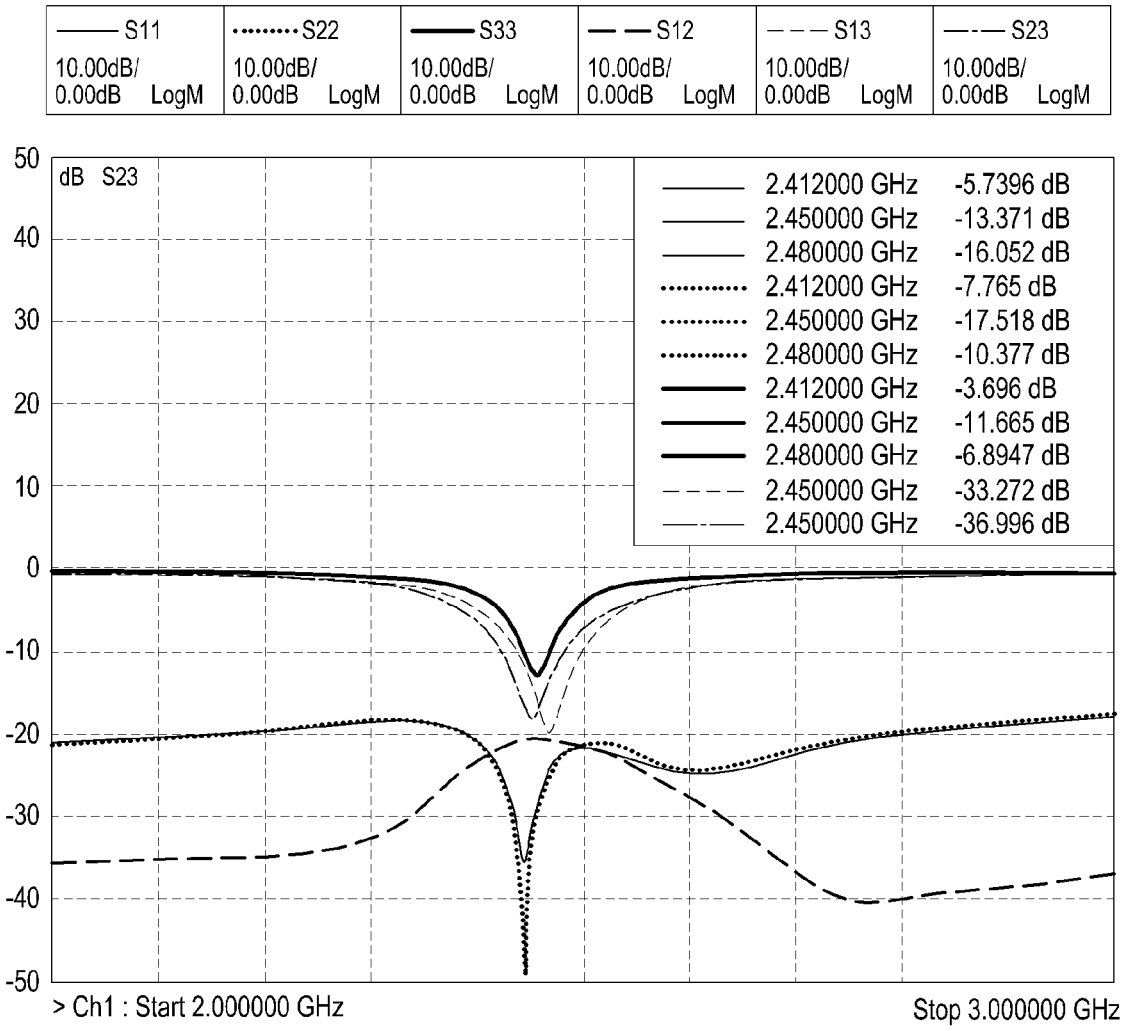
FIG. 8 illustrates a graph representing measurement results of radiation characteristics, which have been measured by implementing an antenna device according to various embodiments of the present disclosure.

FIG. 7 is a graph for describing a radiation characteristic of the antenna device (e.g., the antenna device 300 of FIG. 5) according to still another one of various embodiments of the present disclosure. FIG. 8 is a graph representing measurement results of radiation characteristics, which have been measured by implementing an antenna device according to various embodiments of the present disclosure.

Referring to FIGS. 7 and 8, "SB3" is a graph representing the reflection coefficient of the first radiation conductor 102, which has been measured in the antenna device 300; "SW3" is a graph representing the reflection coefficient of the second radiation conductor(s) 103, which has been measured in the antenna device 300; "CBW3" is a graph representing electromagnetic coupling between the first radiation conductor 102 and the second radiation conductor(s) 103, which has been measured in the antenna device 300; and "CW3" is a graph representing electromagnetic coupling between the second radiation conductors 103, which has been measured in the antenna device 300.

In view of the measurement results of the reflection coefficient, similarly to the antenna device 100 of FIG. 1, it can be seen that each of the first radiation conductor 102 and the second radiation conductors 103 forms a resonance frequency in an about 2.4 to 2.5 GHz band.

Compared to the measurement results of electromagnetic coupling of the antenna device 100 of FIG. 1, it can be seen that the antenna device 300 is improved by about 5 dB in electromagnetic coupling between the first and second radiation conductor(s) 102 and 103 and improved about 11 dB in electromagnetic coupling between the second radiation conductors 103. For example, in the antenna device according to various embodiments of the present disclosure, the electromagnetic coupling between the first radiation conductor 102 and the second radiation conductors 103 and/or the electromagnetic coupling between the second radiation conductors 103 can be improved by forming the connection line(s) 341 together with the slits 217 in the conductive layer 111. Thus, since stable radiation performance can be ensured while the plurality of radiation conductors are disposed adjacent to each other, the antenna device according to various embodiments of the present disclosure may be easily miniaturized while transmitting/receiving wireless signals in a plurality of different frequency bands. For example, by forming the slits 217 and/or the connection line(s) 341, it is easy to miniaturize the antenna device 300, and it is possible to suppress and prevent the occurrence of a sound interruption phenomenon or a noise when a sound signal is transmitted through the first radiation conductor 102 and/or the second radiation conductor(s) 103.

Figure 9:
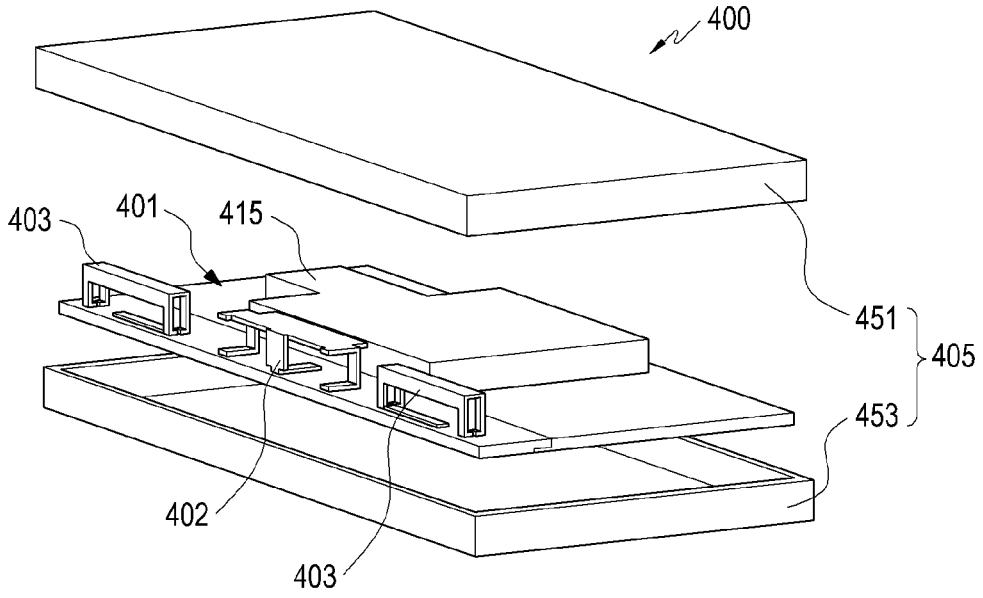
FIG. 9 is a perspective view illustrating an implemented example of an antenna device according to various embodiments of the present disclosure.

FIG. 9 is a perspective illustrating an implemented example of an antenna device 300 (e.g., the antenna device 300 of FIG. 5) according to various embodiments of the present disclosure.

Referring to FIG. 9, the antenna device 400 may include a circuit board 401, a plurality of radiation conductors 402 and 403 mounted on the circuit board 401, and/or a case member 405 that accommodates the circuit board 401.

According to various embodiments, although not illustrated, the circuit board 401 (e.g., the circuit board 101 of FIG. 5) may include a printed circuit pattern and a conductive layer. For example, the printed circuit pattern may interconnect the radiation conductors 402 and 403 (e.g., the first radiation conductor 102, the second radiation conductor(s) 103, and the RFIC chip 415 of FIG. 5), and the conductive layer (e.g., the conductive layer 111 of FIG. 5) may provide a ground to the radiation conductors 402 and 403 and/or the electronic components. In one embodiment, the circuit board 401 may be formed as a multilayer circuit board.

According to various embodiments, among the radiation conductors, the first radiation conductor 402 may be an electrically conductive member mounted on a fill-cut region (e.g., the fill-cut region 113 in FIG. 5) of the circuit board 401, and may be manufactured by cutting and machining a metal plate into a predetermined shape. In one embodiment, the first radiation conductor 402 may be mounted on the circuit board 401 and connected to the RFIC chip 415 through a portion of the printed circuit pattern formed on the circuit board 401. For example, the first radiation conductor 402 may be fed with power from the RFIC chip 415 so as to transmit/receive wireless signals in a first frequency band. Here, the "first frequency band" may include a frequency band for Bluetooth communication. The first radiation conductor 402 has a substantially rectangular shape occupying a space of a square (rectangular parallelepiped) shape, in which the longest side may be disposed adjacent to, or substantially parallel to one side edge of the circuit board 401.

According to various embodiments, among the radiation conductors, the second radiation conductors 403 may be respectively disposed at the both sides of the first radiation conductor 402 (i.e., on opposite sides of the first radiation conductor 402) on the circuit board 401 to be symmetrical to each other. The second radiation conductors 403 may be mounted in a fill-cut region (e.g., the fill-cut region 113 in FIG. 5) of the circuit board 401, and may be connected to the RFIC chip 415 through a portion of the printed circuit pattern formed on the circuit board 401. For example, the second radiation conductors 403 may be fed with power from the RFIC chip 415 so as to transmit/receive wireless signals in a second frequency band that is different from a first frequency band. Here, the "second frequency band" may include a frequency band for WiFi communication. The second radiation conductor 403 is manufactured by machining a metal plate material. The second radiation conductor 403 has a substantially rectangular shape occupying a space of a rectangular shape, in which the longest side may be disposed adjacent to, or substantially parallel to one side edge of the circuit board 401.

The specific embodiment of the present disclosure illustrates the first radiation conductor 402 and the second radiation conductors 403, which are configured by machining a metal plate material, but the present disclosure is not limited thereto. For example, the first radiation conductor 402 and the second radiation conductors 403 may be in the form of other conductive layers and/or a printed circuit pattern formed in the fill-cut region 113. In some embodiments, although not illustrated, the first radiation conductor 402 and the second radiation conductors 403 may be in the form of other conductive layers and/or a printed circuit pattern provided on an auxiliary circuit board, and the auxiliary circuit board may be disposed in the fill-cut region of the circuit board 401.

According to various embodiments, the antenna device 400 may further include a case member 405 that accommodates the circuit board 401 (and/or the radiation conductors 402 and 403, etc.). The case member 405 may be formed by coupling the first case member 451 and the second case member 453 to face each other. The first case member 451 may be disposed to face one surface (e.g., the upper surface) of the circuit board 401, and the second case member 453 may be coupled to the first case member 451 in the state of facing the other surface (e.g., the lower surface) of the circuit board 401. For example, the circuit board 401 may be accommodated between the first case member 451 and the second case member 453.

Although not specifically described in the present embodiment, by including the slit(s) of the above-described embodiments (e.g., the slit 217 of FIG. 5) and/or the connection line(s) (e.g., the connection line 341 of FIG. 5), the antenna device 400 may mitigate or prevent the electromagnetic coupling between the first radiation conductor 402 and the second radiation conductor(s) 403.

Figure 10:
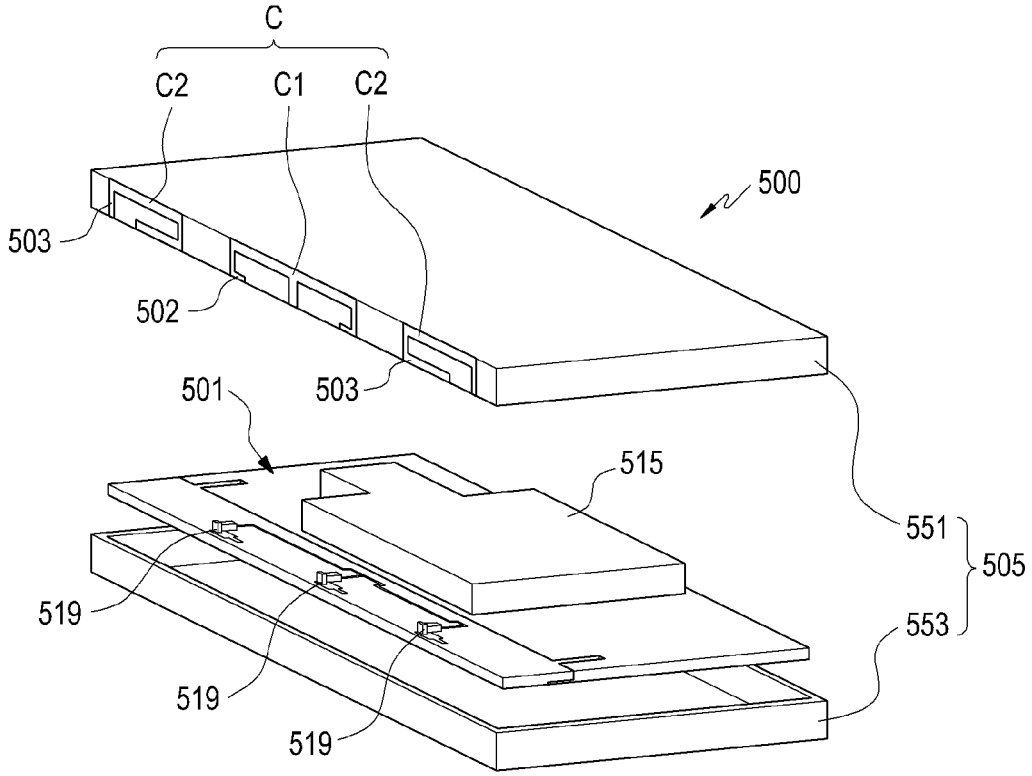
FIG. 10 is a perspective view illustrating another implemented example of an antenna device according to various embodiments of the present disclosure.
Figure 11:
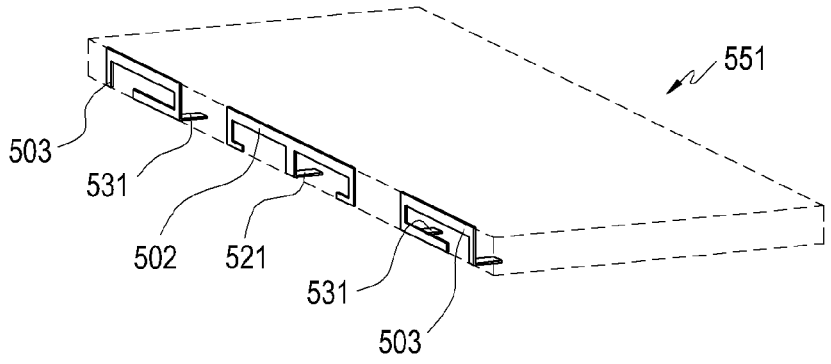
FIG. 11 illustrates a view for describing radiation conductors of another implemented example of an antenna device according to various embodiments of the present disclosure.

FIG. 10 is a perspective view illustrating another implemented example of an antenna device according to various embodiments of the present disclosure. FIG. 11 is a view for describing radiation conductors of another implemented example of an antenna device according to various embodiments of the present disclosure.

Referring to FIGS. 10 and 11, the antenna device 500 may include a circuit board 501, a case member 505 that accommodates the circuit board 501, and/or a plurality of radiation conductors 502 and 503 formed in the case member 505.

According to various embodiments, although not illustrated, the circuit board 501 (e.g., the circuit board 101 of FIG. 5) may include a printed circuit pattern and a conductive layer. For example, the printed circuit pattern may interconnect the radiation conductors 502 and 503 (e.g., the first radiation conductor 102, the second radiation conductor(s) 103, and the RFIC chip 515 of FIG. 5), and the conductive layer (e.g., the conductive layer 111 of FIG. 5) may provide a ground to the radiation conductors 502 and 503 and/or the electronic components. In one embodiment, the circuit board 501 may be formed as a multilayer circuit board. In some embodiments, the circuit board may include a plurality of connection members disposed on one surface thereof. The connection members may be elastic members, such as a C-clip, and each of the connection members may be connected to the RFIC chip 515 through a printed circuit pattern formed on the circuit board.

According to various embodiments, the case member 505 may include a first case member 551 and a second case member 553 which are coupled to face each other, and the circuit board 501 may be accommodated between the first case member 551 and the second case member 553. In one embodiment, at least a portion of the case member 505 (e.g., the first case member 551) may include a conductive material part C, and a portion of the conductive material portion C may form the radiation conductors 502 and 503 (or some of the radiation conductors).

According to various embodiments, among the radiation conductors, the first radiation conductor 502 may include a first conductive material portion C1 of the conductive material part C. The first conductive material portion C1 (e.g., the first radiation conductor 502) may be a portion of the first case member 551. In one embodiment, the first radiation conductor 502 may be disposed at central portion on one side surface of the first case member 551 and adjacent to one side edge of the circuit board 501. In some embodiments, the antenna device 500 may include a first connection terminal 521 (see FIG. 11) extending from the first conductive material portion C1 to the inside of the case member 505.

When the circuit board 501 is accommodated in the case member 505, the first connection terminal 521 may be disposed corresponding to one of the connection members 519. For example, the first connection terminal 521 comes into contact with one of the connection members 519, through which the first conductive material portion C1 (e.g., the first radiation conductor 502) may be connected to the RFIC chip 515. The first radiation conductor 502 may be fed with power from the RFIC chip 515 so as to transmit/receive wireless signals in the first frequency band.

According to various embodiments, among the radiation conductors, the second radiation conductors 503 may include second conductive material portions C2 of the conductive material part C. The second conductive material portions C2 (e.g., the second radiation conductors 503) are a portion of the first case member 551, and may be respectively disposed at the both sides of the first radiation conductor 502 on one side surface of the first case member 551. For example, the second radiation conductors 503 may be disposed to be symmetrical to each other about the first radiation conductor 502, and may be adjacent to one side edge of the circuit board 501. In some embodiments, the antenna device 500 may include second connection terminals 531, which respectively extend from the second conductive material portions C2 to the inside of the case member 505.

When the circuit board 501 is accommodated in the case member 505, the second connection terminals 531 may be disposed respectively corresponding to the remaining ones of the connection members 519. For example, the second connection terminals 531 respectively come into contact with the remaining ones of the connection members 519, through which each of the second conductive material portions C2 (e.g., the second radiation conductors 503) may be connected to the RFIC chip 515. The second radiation conductors 503 may be fed with power from the RFIC chip 515 so as to transmit/receive wireless signals in the second frequency band. The second radiation conductors 503 may transmit/receive radio signals independently from each other, thereby implementing a MIMO function.

Although not specifically described in the present embodiment, by including the slit(s) of the above-described embodiments (e.g., the slit 217 of FIG. 5) and/or the connection line(s) (e.g., the connection line 341 of FIG. 5), the antenna device 500 may mitigate or prevent the electromagnetic coupling between the first radiation conductor 502 and the second radiation conductor(s) 503.

Figure 12:
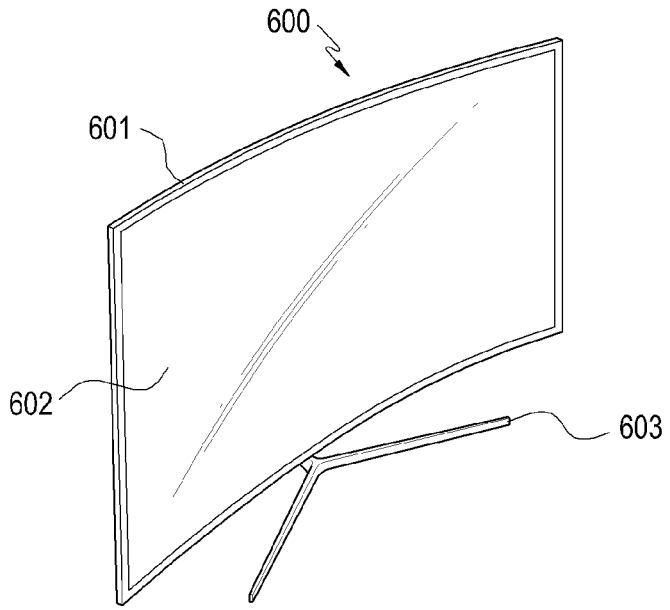
FIGS. 12 and 13 are perspective views each illustrating an electronic device that includes an antenna device according to various embodiments of the present disclosure.
Figure 13:
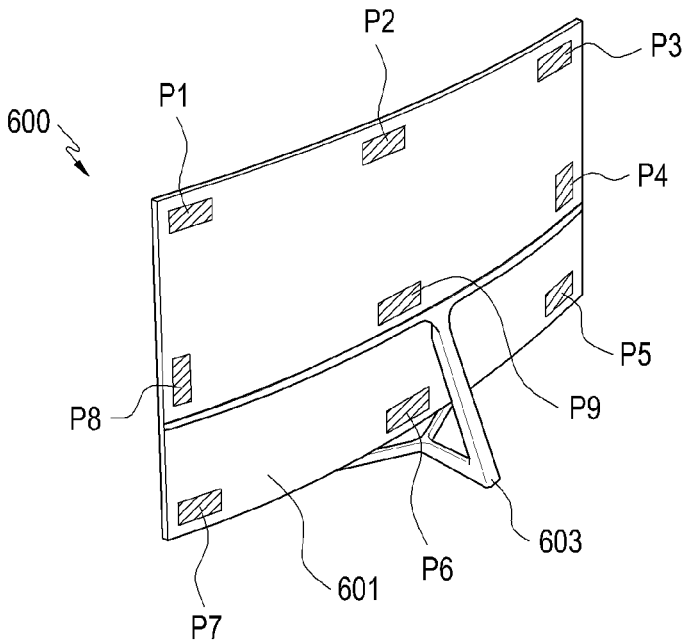

FIGS. 12 and 13 are perspective views each illustrating an electronic device 600 that includes an antenna device according to various embodiments of the present disclosure.

FIGS. 12 and 13 illustrate an example of the electronic device 600 according to various embodiments of the present disclosure, in which the electronic device 600 may be a TV that includes a housing 601, a display device 602, and a stand 603. In a specific embodiment of the present disclosure, while the TV is exemplified as the electronic device on which the above-described antenna devices are mounted, the present disclosure is not limited thereto. For example, the above-described antenna device may be mounted on various electronic devices, such as household electric appliances (e.g., a refrigerator, an air conditioner, and an electric oven), and office electronic products (e.g., a printer, a copier, and a facsimile).

The housing 601 may be made of a metallic material and/or a synthetic resin, and the display device 602 may be mounted on the front surface. The stand 603 is mounted on the rear surface of the housing 601 and extends to the lower side of the housing 601, so that the electronic device 600 can be disposed on a plane. The display device 602 may include any one of, for example, a liquid crystal display panel, a plasma display panel, and an organic light emitting diode panel.

The electronic device 600 may be wirelessly connected to a user device (e.g., a mobile communication terminal or a tablet PC) so as to transmit/receive a multimedia file. For example, the electronic device 600 may include any one of the above-described antenna devices, thereby transmitting/receiving a video image file to/from the user device, or performing a moving image streaming function in cooperation with the user device.

In some embodiments, the electronic device 600 may include any one of the above-described antenna devices, thereby transmitting sound signals to an external speaker. For example, the electronic device 600 may be wirelessly connected to an external speaker through the antenna device described above, and may output sound through an external speaker while also outputting the sound through the display device 602.

In disposing the antenna device (e.g., the antenna device 400 or 500 of FIG. 9 or 10) is on the electronic device 600, the antenna device 400 or 500 may be disposed on either side to the display device 602. For example, the display device 602 is generally disposed on the front surface of the electronic device 600 (e.g., the housing 601), and a bezel region may be provided around the display device 602 on the front surface of the electronic device 600. However, the front surface of the electronic device 600 may be too narrow to install the antenna device. Accordingly, the antenna device 400 or 500 may be disposed on the rear surface of the housing 601 (e.g., the surface facing the direction opposite to the display device 602). In one embodiment, the antenna device 400 or 500 may be disposed at any one of locations P1, P2, P3, . . . , P9 illustrated in FIG. 13. However, depending on the structure and the shape of the electronic device or the installation environment of the electronic device, the antenna device 400 or 500 may also be installed at locations other than the locations illustrated in FIG. 13.

According to various embodiments, the panel(s) of the display device 602 may include a circuit wiring that is generally formed over the entire area thereof to provide electrical signals to the pixels. The above-described circuit wiring (or a combination of circuit wirings) may shield and reflect wireless signals. For example, generally speaking, a space in which the antenna device 400 or 500 radiates wireless signals in the state where the antenna device 400 or 500 is mounted on the electronic device 600 is a rear side space of the housing 601.

Figure 14:
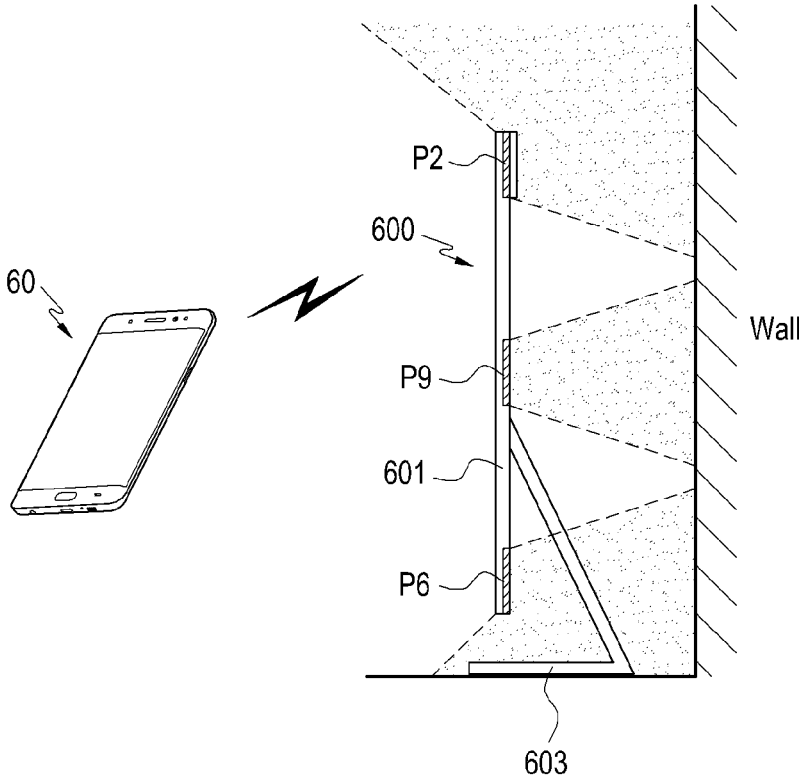
FIG. 14 is a configuration view illustrating an aspect in which an electronic device according to various embodiments of the present disclosure is installed.

FIG. 14 is a configuration view illustrating an aspect in which an electronic device (e.g., the electronic device 600 of FIG. 12 or 13) according to various embodiments of the present disclosure is installed.

Further referring to FIG. 14, when the electronic device 600 is disposed indoors, the electronic device 600 may be disposed adjacent to a wall such that the rear surface of the housing 601 faces the wall. In transmitting/receiving wireless signals, a wall in an indoor space may also be an obstacle to block or absorb wireless signals. For example, a potential location where the antenna device 400 or 500 may be placed on the electronic device 600, a location where the electronic device 600 may be installed in an indoor space, or the like may make the operating environment of the above described antenna device(s) poor.

For example, when the antenna device 400 or 500 is installed at a point indicated by "P9" in FIG. 13, it is substantially impossible for the antenna device 400 or 500 to radiate wireless signals to the front side of the housing 601, and when the rear surface of the housing 601 is adjacent to a wall, the wireless signals emitted by the antenna device disposed at the point indicated by "P9" may be mostly blocked and absorbed by the wall. Since a user device to perform transmission/reception of video image files to/from the electronic device 600 or an external speaker to receive sound signals is generally disposed on the front side of the electronic device 600 (e.g., the housing 601), installing the antenna device 400 or 500 at the point indicated by "P9" may degrade wireless signal transmission/reception performance.

According to various embodiments, since the antenna device is disposed at one side edge on the rear surface of the housing 601, it is possible to secure good wireless signal transmission/reception performance even in a poor installation environment. For example, the antenna device 400 or 500 may be mounted at the both side ends, at the top end, and/or at the bottom end (the point indicated by "P2" and/or the point indicated by "P6") on the rear surface of the housing 601. When the antenna device 400 or 500 is disposed at an edge of the housing 601, the antenna device 400 or 500 may be located in a region that does not at least partially overlap the display device 602, so that it is possible to secure an environment in which wireless signals can be radiated to the front side of the housing 601. In general, the lower end of the housing 601 may be disposed adjacent to a floor or a table, so that a better wireless signal transmission/reception environment may be better when the antenna device 400 or 500 is disposed at the upper end.

Figure 15:
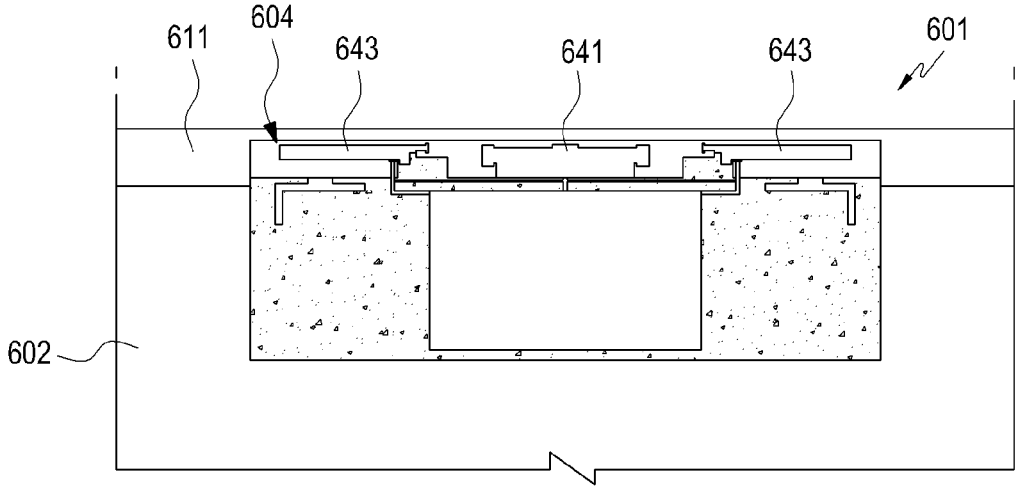
FIG. 15 is a configuration view illustrating a state in which antenna devices are disposed in the electronic device according to various embodiments of the present disclosure.

FIG. 15 is a perspective view illustrating a state in which the antenna devices 604 are disposed in the electronic device 600 according to various embodiments of the present disclosure (e.g., the electronic device 600 of FIG. 12 or 13).

Further referring to FIG. 15, the housing 601 may include a frame and/or a bezel region 611 for mounting and supporting the edges of the display device 602. In one embodiment, when the antenna device 604 is disposed at an edge of the housing 601, the first radiation conductor 641 and the second radiation conductors 643 of the antenna device 604 may be arranged along the edge of the housing 601. For example, the first radiation conductor 641 and the second radiation conductors 643 may be disposed in the bezel region 611 on the housing 601. Accordingly, each of the first radiation conductor 641 and the second radiation conductors 643 can also stably transmit/receive wireless signals to/from a user device or an external speaker disposed at the front side of the housing 601. For example, by disposing the first radiation conductor 641 and the second radiation conductors 643, which will substantially transmit/receive wireless signals, in a region that is located on the rear surface of the housing 601 and does not overlap the display device 602 (e.g., the bezel region 611), the electronic device 600 can secure a good wireless transmission/reception environment with other electronic devices 60, such as a user device or an external speaker.

Figure 16:
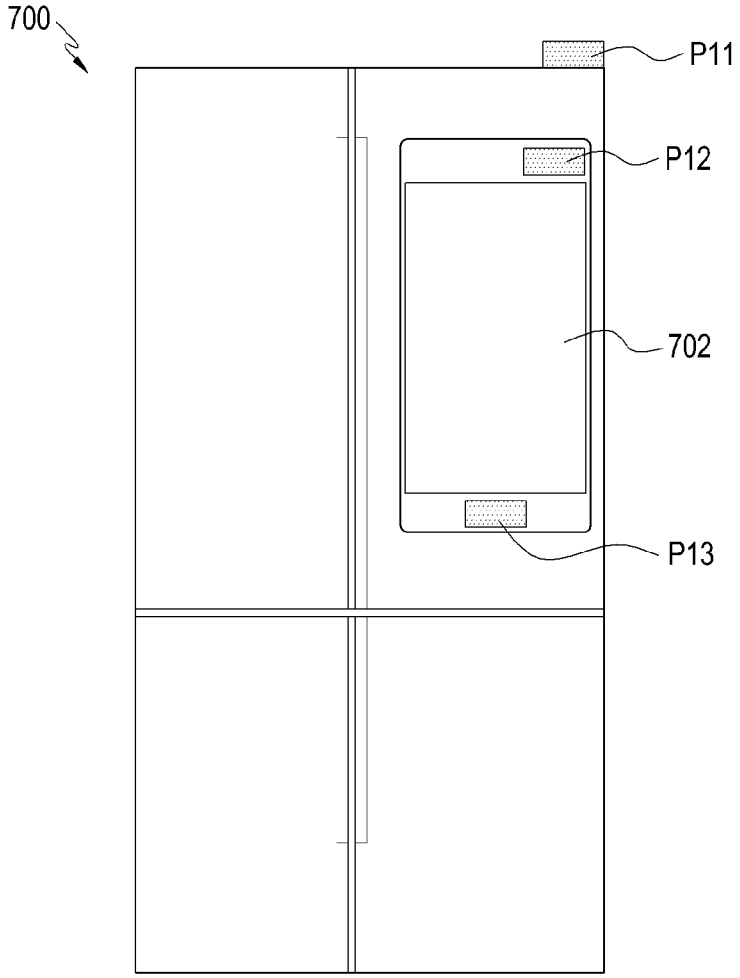
FIG. 16 is a front view illustrating another antenna device including an antenna device according to various embodiments of the present disclosure.

FIG. 16 is a front view illustrating another antenna device including an antenna device 700 according to various embodiments of the present disclosure.

Referring to FIG. 16, the antenna device 700 is a refrigerator, which may include a display device 702 mounted on a door panel. In one embodiment, at least one of the above-described antenna devices may be mounted on the upper end or the door panel of the antenna device 700 as indicated by "P11." According to some embodiments, the above-described antennas device may be mounted on the upper end P12 of the display device 702 and/or the lower end P13 of the display device 702 on the door panel.

According to various embodiments of the present disclosure, there are provided an antenna device and/or an electronic device including the antenna device. The antenna device may include: a circuit board; a conductive layer disposed in a partial region of the circuit board; a first radiation conductor disposed at one side of the conductive layer on the circuit board; and second radiation conductors disposed at the one side of the conductive layer on the circuit board, the second radiation conductors being respectively disposed at both sides of the first radiation conductor to be symmetrical to each other. The first radiation conductor may transmit/receive a wireless signal in a first frequency band, and the second radiation conductors may transmit/receive a wireless signal in a second frequency band that is different from the first frequency band.

According to various embodiments, the first radiation conductor and the second radiation conductors may be arranged along an edge of the circuit board.

According to various embodiments, the antenna device may further include slits, each of which is formed partially across the conductive layer in regions that are respectively adjacent to the second radiation conductors.

According to various embodiments, the slits may be formed at the both sides of the first radiation conductor to be symmetrical to each other.

According to various embodiments, the antenna device may further include a first feed line connected to the first radiation conductor, second feed lines respectively connected to the second radiation conductors, and a connection line connecting each of the second feed lines to the first feed line.

According to various embodiments, the connection line may include at least one lumped element disposed between the first feed line and each of the second feed lines.

According to various embodiments, the antenna device may further include slits, each of which is formed partially across the conductive layers in regions that are respectively adjacent to the second radiation conductors.

According to various embodiments, the slits may be formed at the both sides of the first radiation conductor to be symmetrical to each other.

According to various embodiments, each of the first radiation conductor and the second radiation conductors includes an electrically conductive member mounted on the circuit board.

According to various embodiments, the antenna device may further include a case member that accommodates the circuit board.

According to various embodiments, the case member may include a first case member disposed to face a first surface of the circuit board, and a second case member coupled to the first case member in a state of facing a second surface of the circuit board, which is opposite to the first surface of the circuit board, and the circuit board may be accommodated between the first case member and the second case member.

According to various embodiments, the case member may at least partially include a conductive material part, and a portion of the conductive material part may form at least a portion of the first radiation conductor and the second radiation conductors.

According to various embodiments, the case member may include a first conductive material portion that forms the first radiation conductor and second conductive material portions that respectively form the second radiation conductor.

According to various embodiments, the antenna device may further include: a first connection terminal extending from the first conductive material portion to an inside of the case member; second connection terminals each extending from one of the second conductive material portions to the inside of the case member; and connection members disposed respectively corresponding to the first connection terminal and the second connection terminals.

An electronic device according to various embodiments of the present disclosure may include the antenna device as described above.

According to various embodiments, the electronic device may further include a housing that accommodates the antenna device.

According to various embodiments, the electronic device may further include a display device mounted on a first surface of the housing, and the antenna device may be disposed at one side edge on a second surface of the housing, which is opposite to the first surface of the housing.

According to various embodiments, the first radiation conductor and the second radiation conductors may be arranged along an edge of the housing.

While the present disclosure has been shown and described with reference to certain embodiments thereof, it will be understood by those skilled in the art that various changes in form and details may be made therein without departing from the spirit and scope of the present disclosure as defined by the appended claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An antenna device comprising:

a circuit board;

a conductive layer disposed in a partial region of the circuit board;

a first radiation conductor disposed at one side of the conductive layer on the circuit board;

second radiation conductors disposed at the one side of the conductive layer on the circuit board, the second radiation conductors being respectively disposed at opposite sides of the first radiation conductor to be symmetrical to each other; and a plurality of slits, each of which is formed partially across the conductive layer in regions that are respectively adjacent to the second radiation conductors, wherein the first radiation conductor transmits or receives a wireless signal in a first frequency band, and the second radiation conductors transmit or receive a wireless signal in a second frequency band that is different from the first frequency band.

2. The antenna device of claim 1, wherein the first radiation conductor and the second radiation conductors are arranged along an edge of the circuit board.

3. The antenna device of claim 1, wherein the plurality of slits are formed at the opposite sides of the first radiation conductor to be symmetrical to each other.

4. The antenna device of claim 1, wherein each of the first radiation conductor and the second radiation conductors includes an electrically conductive member mounted on the circuit board.

5. The antenna device of claim 1, further comprising:

a case member that accommodates the circuit board.

6. The antenna device of claim 5, wherein the case member includes a first case member disposed to face a first surface of the circuit board, and a second case member coupled to the first case member such that the second case member faces a second surface of the circuit board, the second surface of the circuit board opposite to the first surface of the circuit board, and the circuit board is accommodated between the first case member and the second case member.

7. The antenna device of claim 5, wherein the case member includes a conductive material part, and a portion of the conductive material part forms at least a portion of the first radiation conductor and the second radiation conductors.

8. The antenna device of claim 5, wherein the case member includes a first conductive material portion that forms the first radiation conductor and second conductive material portions that form the second radiation conductors, respectively.

9. The antenna device of claim 8, further comprising:

a first connection terminal extending from the first conductive material portion to an inside of the case member; second connection terminals each extending from one of the second conductive material portions to the inside of the case member; and connection members disposed respectively corresponding to the first connection terminal and the second connection terminals.

10. The antenna device of claim 1, further comprising:

a housing that accommodates the antenna device.

11. The antenna device of claim 10, further comprising:

a display device mounted on a first surface of the housing, wherein the antenna device is disposed at one side edge on a second surface of the housing, the second surface of the housing opposite to the first surface of the housing.

12. The antenna device of claim 10, wherein the first radiation conductor and the second radiation conductors are arranged along an edge of the housing.

13. The antenna device of claim 1, further comprising a radio frequency integrated circuit (RFIC) chip, wherein the first radiation conductor and the second radiation conductors are electromagnetically coupled to the RFIC chip.

14. An antenna device comprising:

a circuit board;

a conductive layer disposed in a partial region of the circuit board;

a first radiation conductor disposed at one side of the conductive layer on the circuit board;

second radiation conductors disposed at the one side of the conductive layer on the circuit board, the second radiation conductors being respectively disposed at opposite sides of the first radiation conductor to be symmetrical to each other, a first feed line connected to the first radiation conductor;

second feed lines connected to the second radiation conductors, respectively; and a connection line connecting each of the second feed lines to the first feed line, wherein the first radiation conductor transmits or receives a wireless signal in a first frequency band, and the second radiation conductors transmit or receive a wireless signal in a second frequency band that is different from the first frequency band.

15. The antenna device of claim 14, wherein the connection line is capacitively coupled to the conductive layer.

16. The antenna device of claim 14, wherein the connection line includes at least one lumped element disposed between the first feed line and each of the second feed lines.

17. The antenna device of claim 14, further comprising:

a plurality of slits, each of which is formed partially across the conductive layer in regions that are respectively adjacent to the second radiation conductors.

18. The antenna device of claim 17, wherein the plurality of slits are formed at the opposite sides of the first radiation conductor to be symmetrical to each other.

19. The antenna device of claim 17, wherein the plurality of slits, the connection line, and the conductive layer form a loop circuit.

* * * * *